United States Patent [19]

Hartmann et al.

[11] Patent Number: 4,842,915

[45] Date of Patent: Jun. 27, 1989

[54] TUFTING BASE FOR CARPETS MADE OF A SPUNBONDED FABRIC, A METHOD OF MANUFACTURING THE BASE, AND A TUFTING CARPET

[76] Inventors: Ludwig Hartmann, Mozartstrasse 11, 6940 Weinheim; Engelbert Loecher, Theodor-Storm-Strasse 39, 6520 Worms; Ivo Ruzek, Am Harzhuebel 56; Norbert Weber, Keltenweg 75, both of 6750 Kaiserslautern, all of Fed. Rep. of Germany

[21] Appl. No.: 130,282

[22] Filed: Dec. 8, 1987

[30] Foreign Application Priority Data

Dec. 10, 1986 [DE] Fed. Rep. of Germany ..... 3642089

[51] Int. Cl.[4] ..... D04H 1/04

[52] U.S. Cl. ..... 428/95; 28/103; 264/103; 264/178 F; 428/198; 428/296; 428/283; 428/288

[58] Field of Search ..... 428/95, 198, 296, 283, 428/288; 28/103; 264/103, 176 F, 177 F, 178 F

[56] References Cited

U.S. PATENT DOCUMENTS

| | | | |
|---|---|---|---|
| 4,424,250 | 1/1984 | Adams et al. | 428/296 |
| 4,568,581 | 2/1986 | Peoples | 428/296 |
| 4,732,809 | 3/1988 | Harris et al. | 428/296 |

*Primary Examiner*—Marion E. McCamish
*Attorney, Agent, or Firm*—Keil & Weinkauf

[57] ABSTRACT

A spunbonded fabric is described that is made of polyester matrix filaments and a binding component consisting of thermoplastically softenable fibers, filaments or the like, and that is suitable for use as a tufting base. The melting point of the polyester matrix filaments is by at least 90° C. above that of the binding component. In the tufted condition, before the coating of the back, the maximum tensile stretching value of the carpet material is more than 50%.

6 Claims, No Drawings

TUFTING BASE FOR CARPETS MADE OF A SPUNBONDED FABRIC, A METHOD OF MANUFACTURING THE BASE, AND A TUFTING CARPET

The invention relates to a spunbonded fabric consisting of polyester matrix filaments that is suitable to be used as a tufting base for carpets and that is strengthened by means of a binding component in the form of thermoplastically softenable fibers, filaments, a powder and/or fine-grained granulates. A process is also claimed for producing said tufting base as well as carpets that are made of it.

The use of spunbonded fabrics as a base material for tufted carpets is known. In contrast to the originally used base materials consisting of jute fabrics or polypropylene fillets, the use of spunbonded fabrics results in a significantly improved appearance of the carpet. The penetrating of the needles during the tufting process is facilitated, and the tendency toward the occurrence of bowed wefts is reduced. Spunbonded fabrics that, on the one hand, are made of polypropylene with autogenous bonds or, on the other hand, of polyester filaments, are on the market as tufting bases. The latter may be strengthened by suitable binding threads, such as low-melting polyesters or polyamides. Structures of this type can be developed to be very stable. In the tufted state, they have a high starting modulus and a low expansion. Although the use of spunbonded fabrics of this type has resulted in considerable progress, disadvantages still exist during the aftertreatment of the tufted carpet,for example, during the wet processes, such as dyeing, steaming and washing, as well as during the thermal processes and during the drying and the coating of the back.

Particularly the filaments that are bonded by means of low-melting polyesters or polyamides, the matrix of which consists of polyester fibers or filaments, have a high resistance to temperature, if necessary, up to more than 200° C., but the binding components are moisture-sensitive. This has a disadvantageous and limiting effect during the wet processing stages. Although autogenously bonded polypropylene fabric bases are not sensitive to moisture, they are impaired in the thermal processing stages by the relatively low melting point of the polypropylene.

Despite the numerous differently composed spunbonded fabrics that have become known as tufting base materials, it has not been possible to achieve an optimal behavior. Nevertheless, the requirements with respect to a tufted carpet are rising continuously. Thus, for example, in the case of layout merchandise for residential and industrial spaces, a high initial tearing resistance and resistance to tear propagation is demanded, while, in the case of extensively deformed tufted carpets, for example, for automobile carpet, a particularly good expansion behavior after the tufting is desirable. In the latter case, the deformation temperature must also be as low as possible which results in an increase of the performance of the deforming facility.

The invention is based on the objective of further developing a spunbound fabric consisting of polyester matrix filaments that is suited for use as a tufting base for carpets, in such a way that, while after the tufting the carpet has a perfect appearance, the spunbonded fabric has the high initial tearing resistance and resistance to tear propagation that is endeavored for merchandise for the laying-out of spaces, as well as the good expansion behavior that is required, for example, for automobile carpets. The use of modern deforming facilities during the manufacturing of automobile carpets makes it necessary that the expansion behavior corresponds to the high machine speed. This means that, despite the required stability characteristics, a maximum tensile expansion is endeavored that is increased as compared to conventional spunbonded fabrics.

This objective is achieved by means of the tufting base made of a spunbonded fabric that is indicated in the claims as well as the process developed for its manufacturing.

The bonded-fabric base consists of polyester matrix filaments and is bonded with polyolefines as the binding component, in which case it was surprisingly found that a perfect solution to the problem was achieved at the point in time when the polyolefine component was largely started to melt and/or melted open. It is expedient to spin the binding component made of polyolefines simultaneously with the matrix filaments, either in the form of separate filaments or as a component of bicomponent fibers, because this results in a uniform mixing of matrix threads and binding threads. The bicomponent fibers are either structured laterally, i.e., side-to-side, or are structured to be cladded core fibers. The binding component may also be used in the form of a powder.

However, the objective that is to be achieved according to the invention will, when these materials are used, be achieved only if the melting point of the polyester matrix filaments is at least 90° C. above that of the binding component. At the same time, the spinning and strengthening process must be adjusted in such a way that the spunbonded fabric, in the tufted state before the coating of the back, has a maximum tensile expansion of more than 50%, relative to the initial state.

The indicated interval between the melting points of the polyester matrix filaments and that of the binding component facilitates the strengthening process and makes it possible to develop the binding points in a very defined way resulting in cohesive bonds.

Polyester matrix filaments of polyethylene terephthalate are particularly suitable.

The binding component advantageously consists of polyolefines, particularly of polypropylene and polyethylene.

The melting points of the polyester matrix filaments are in the range of 250°-260° C., while the binding component, when, for example, suitble polypropylenes are used, melts in the range of 150°-160° C., and when suitable polyethylenes are used, in the range of 120°-130° C.

The polyester matrix filaments form a network that has a very good bearing capacity and is thermoresistant, while the compounds consisting of polyolefines provide the bond with high stability at low temperatures. The specific characteristics of both components are utilized optimally. Although, in the case of the indicated composition, because of the high stability, it might be expected that the expansion behavior of the tufted material may become more difficult, for example, during the deep-drawing, it was surprisingly found that after the tufting process, very high stretching abilities are achieved. This is the prerequisite for the deforming of the material, for example, in the manufacturing of automobile carpets. After the tufting, values for the maximal tensile stretching of more than 50% can be set.

The high deformability and the low softening temperatures of the binding component permit the deformation at relatively low temperatures and result in an increase in the performance of the deforming facility.

As a result of the polyester matrix, a very stable bond is achieved that also has little sensitivity with respect to moisture and is therefore far superior to the conventional polyester bonded-fabric bases that are bonded with low-melting polyesters or polyamides. By means of a suitable coating of the back, the spunbonded-fabric bases that are structured according to the invention, after the tufting, can be further durably stabilized, which is desirable for use in areas within objects and residences.

The tufting base according to the invention makes possible a deformation of the tufted carpet material also in extreme cases. In the case of the conventional tufted carpets, this led to enormous difficulties. The woven tufting bases were only very slightly deformable, in which case the anisotropy of the base structure with the characteristic alignment of the yarn in the direction of the warp and of the woof had a particularly disadvantageous effect. Although the conventional bonded-fabric bases in this regard, because of their almost isotropic force - stretching behavior had an advantage, they were impaired either by their matrix or by the binding component. Thus the autogenously bonded fabrics consisting of polypropylene fibers are not sufficiently thermoresistant, particularly when the carpet that is tufted on this base, as usual, also receives a coating of polyethylene. Although the previously known bonded-fabric bases made of polyester matrix fibers are sufficiently thermoresistant, they require a very high deforming temperature, particularly if extreme shapes are to be made. However, even under these conditions, the deformability is limited by the insufficient plasticity of the binder component, which, among other things, is exhibited by unsatisfactorily low yields of perfectly deformed carpets, and limits the efficiency and economy of manufacturing. It was also found that the product according to the invention requires significantly shorter deforming times which represents a significant efficiency factor.

Surprisingly, it was found that, as a result of the composition of the base material described according to the invention, all disadvantages of the known tufted carpets with woven bases or bases that are structured on a bonded-fabric base are eliminated. The following examples reflect the composition and the spinning conditions.

The required maximal tensile stretching can, if necessary, be adapted to the respective usage by a corresponding variation of the setting conditions.

EXAMPLE 1

For the manufacturing of a spunbonded fabric according to the invention, a spinning facility is used that consists of a plurality of spinning points, as described in the German Patent Text No. 22 40 437. Each spinning point has two spinning nozzles (A and B) of an oblong shape with spinning bores that are arranged in rows and in parallel to one another. The individual spinning points of the spinning facility, with respect to one another, have a distance of 400 mm, in which case the oblong spinning nozzles of the whole system are arranged in parallel and in a diagonal arrangement over a whole collecting belt, similar to the obliquie-angled arrangement shown in the German Published Patent Application No. 15 60 799.

Spinning nozzle A is used for the spinning of system yarn and comprises 64 bores, the capillary diameter of which is 0.3 mm, and the capillary length of which is 0.75 mm. The bores are arranged in two mutually offset rows over a length of 280 mm.

Spinning nozzle B is used for the spinning of binding threads and has 32 bores that are evenly distributed in a row over the length of 280 mm, with the same capillary diameter as spinning nozzle A.

All spinning nozzles A of the spinning facility are combined to a spinning system A and are supplied with polyester melt by means of a spinning extruder, in which case each spinning nozzle is equipped with a spinning pump.

All spinning nozzles B are also combined to a spinning system B and via a spinning extruder are supplied with polypropylene melt. The threads that are formed by the two spinning nozzles of each spinning point, below the spinning nozzle, on a course of 150 mm, are exposed to blown air transversely to the raising of the thread and are subsequently combined in the shape of an oblong group of threads, in which both thread components are mixed evenly, are guided through the cooling shaft and supplied to an aerodynamic withdrawal element.

The aerodynamic withdrawal element is a withdrawal duct of an oblong shape, the length of which is 300 m and the width of which is 6 mm. Onboth longitudial sides, this withdrawal duct is equipped with a compressed-air withdrawal slot that extends over the whole length of 300 mm and that is connected to a compressed-air chamber. By means of the adjustment of the air pressure, the air velocity in the duct profile is varied and thus the thread withdrawal conditions are controlled. The traight-lined bands of threads emerging from the lower air duct openings which, in each case consist of very well mixed polyester and polypropylene threads extending in parallel to one another. are then, by means of a swinging device, set into a periodic pendulum motion and supplied to a metallic travelling screen that moves transversely to the pendulum direction. By means of the impacting of the straight-lined thread bands on the travelling screen, a tangled bonded fabric is formed. The propellant air, by means of which the threads are withdrawn, is sucked off under the travelling screen.

Directly behind the deflection roller of the continuous travelling screen located in moving direction, a calender is arranged, the operating part of which consists of two differently heated rollers. It is the objective of this calender to achieve a sufficient prestrengthening of the bonded fabric that differs, however, throughout the thickness of the bonded fabric. For this purpose, the upper calender roller is heated to a lower temperature than the lower one.

The prestrengthened bonded fabric will then be sprayed on one side with an aqueous emulsion of dimethyl polysiloxane and hydroxymethyl polysiloxane, in which case the two components can be polymerized at a higher temperature, so that essentially only the upper, already more easily prestrengthened and more open side of the bonded fabric is wetted with the emulsion. The thus prestrengthened bonded fabric is then supplied to the actual strengthening apparatus. This apparatus consists of a screening drum with a circulating continuously travelling screen. The bonded fabric is introduced into the gap between the screening drum and the circulating travelling screen and in this way, during the strengthening, is held above the surface and pressed against the drum, in which case the soft side that is wetted by the brightening agent, faces the drum. From the direction of the screen, hot air flows through the bonded fabric, in which case the polypropylene threads start to melt and cohesive bonds are formed to the polyester threads.

TABLE 1

| | Spinning System A Polyethylene Terephthalate | Spinning System B Polypropylene |
|---|---|---|
| Rel. Viscosity in the o-dichlorobenzene (2 parts by weight) - phenol (3 parts by weight) | 1.36 | |
| Melt-flow index (MFI) (230° C., 1.16 kp) | | 19 ±1 |
| Temperature of melt (°C.) | 290 | 270 |
| Delivery per spinning nozzle (kg/min) | 0.7 | 0.15 |
| Thread speed (m/min.) | 4,000 | 4,200 |
| $v_o$ - at hole outlet (m/min.) | 23 | 15 |
| $v_s$ - in withdrawal duct (m/min.) | 5,000 | 5,000 |
| Air speed in withdrawal duct (m/min.) | 13,000 | 13,000 |
| Yarn Values: | | |
| Titer (dtex) | 12 | 5 |
| Closeness (p/dtex) | 3.4 | 2.0 |
| Stretching ability (%) | 90 | 300 |
| Boiling shrinkage (%) | 1 | 0 |

Before the spinning, the polyethylene terephthalate has a relative viscosity of 1.36, measured as 0.5%-solution in a mixture of o-dichlorobenzene (2 parts by weight) and phenol (3 parts by weight). Polypropylene is a product with a melt-flow index (MFI) of 19 g/min.

The weight per unit area of the bonded tangle fabric, during the manufacturing, is set to 120 g/m$^2$. The upper roller of the strengthening calender is heated to a temperature of 95°, and the lower one is heated to 115°. The line pressure is 50 kp/cm width.

The application of the brightening agent is controlled via the spraying device in such a way that on the upper side, per m$^2$, 0.10 g of a hydroxymethyl polysiloxane and 0.15 g dimethyl polysiloxane are applied.

The temperature of the hot air in the strengthening apparatus is set at 205° C., in which case the bonded fabric is subjected to the flow for 60 seconds, with an amount of 1.9 cbm/m$^2$/sec screen surface. The finished bonded fabric has the following physical characteristics:

TABLE 2

| | Longitudinally | Transversely |
|---|---|---|
| Maximum tensile force (N) | 210 | 200 |
| Maximum tensile stretching | 40 | 40 |
| Piercing resistance (N) measured from the soft side | 5.0 | |
| measured from the hard side | 6.80 | |
| Flexural strength (N/cm$_2$) measured from the soft side | 158 | 86 |
| measured from the hard side | 36 | 42 |
| Linear shrinkage in hot air at 160° C. (%) | 1 | 2 |

The maximum tensile force in the case of the untufted bonded fabric is measured according to DIN 53 857; in the case of the tufted material, the process is similar, in which case the test pieces are, on the one hand, removed in machine direction (longitudinal direction) and, on the other hand, transversely to the machine direction (transverse direction).

For the testing of the piercing resistance, our own testing method is used, in which the tafting base, in the form of a 5 cm wide strip, is penetrated with a number of Singer needles (GY 0637 type) without yarn. The piercing resistance that the material exhibits is determined via an electronic measuring head, is stored in a computer and is evaluated as a mean value from about 600 piercings.

For the measuring of the flexural strength, our own testing method is also used, in which case the force is measured that is required for bending a test strip. In this case, the material is clamped in in moving direction of the machine of the production facility (longitudial direction) as well as in transverse direction to the production operation. In order to test the differences in the strengthening of the material via the thickness, the test is carried out from the soft side of the bonded fabric (entering side of he tufting needles) as well as from the hard side.

Linear shrinkage is tested on a DIN A4 test piece that, in a drying chamber that is adjusted to the testing temperature, is exposed to the effect of the hot air for 10 minutes while it is horizontally exposed.

In addition, the finished strengthened bonded fabric is subjected to an extraction analysis in water, in which it is determined that only a small, not precisely measurable fraction of the applied silicon component changes over into the extract. As a result, the important prerequisite is provided that the material, during the continuous dyeing, can have no disadvantageous effect on the foam formation in the dyeing fluid.

The bonded fabric produced according to Example 1 is used as the tufting base, in which case the operation takes place on a tufting loom with a needle gauge of 0.397 cm and a stitch density of 0.32 cm. A curled PA filament yarn is used that has an overall titer of 2,900 dtex (Dupont Nylon 876). The tufting machine is equipped with Singer needles (GY 0637 type). During the tufting operation, the material is turned to the tufting needles with its soft side (entering side). The intermediate material that was tufted in this way has the physical characteristics summarized in Table 3:

TABLE 3

| | Longitudinally | Transversely |
|---|---|---|
| Maximum tensile force (N) | 230 | 220 |
| Maximum tensile stretching (%) | 56 | 62 |
| Tear propagation force (N) | 230 | |

The determination of the tear propagation force takes place according to DIN 53 859, Part 3 (draft)—tear propagation test according to Wegener. The dimensions of the test pieces are 200×150 mm, and testpiece, in the center of the short edge, is equipped with a 100 mm long cut edge in parallel to the longer edge. This test piece is then clamped into a dynamometer, so that the cut edge is located vertically to the load direction. When load is applied to the sample, the maximally required force is read. The test piece is cut along the tufted rows.

The carpet breadth, during winch vat dyeing as well as during dyeing on a continuous facility, has very good dimensional stability. Thus the loss of width during the processing amounts to only 3% of the initial width. The carpet breadth also has very good dimensional stability over the whole surface. Thus, in the case of a precisely geometrical pattern that is printed on the carpet, the largest deviation from a straight line is less than 1 cm over the width of 404 cm.

The thermal stability of the material is so good that the drying temperature after the dyeing or printing can be raised to 170° C., in which case, this temperature is limited only by the thermal stability of the carpet yarn and the used dyes. The coating of the carpet takes place conventionally in two phases. In the first phase, the yarn loops are bound in by means of a Latex dispersion that is applied by means of at least two slop padding devices that are connected behind one another. This precoating is prevulcanized in a dryer. The applied quantity amounts to 800 g/m$^2$, relative to the dry substance.

In the second phase, the back side is provided with a Latex foam of a thickness of 4 mm, and the coating is completely vulcanized. The course of the coating also results in a proof of the excellent surface stability of the carpet widths, although the operation in the dryer takes place at a temperature of 160°.

After being spread out on a smooth surface over a length of 20 m, the finished carpet is distinguished by a very flat lying behavior that is free of disturbances. In the case of the finished product, stability values were achieved that are summarized in Table 4.

TABLE 4

| | Longitudinally | Transversely |
|---|---|---|
| Maximum tensile force (N) | 390 | 350 |
| Maximum tensile stretching (%) | 53 | 38 |
| Tear propagation force (N) | 160 | |

TABLE 5

| Typical Quality Characteristics | | |
|---|---|---|
| Maximum tensile force | longitudinally | 325 N |
| | transversely | 300 N |
| Maximum tensile stretching | longitudinally | 39% |
| | transversely | 36% |
| Tear propagation force | longitudinally | 130 N |

TABLE 6

| Typical Quality Characteristics | | |
|---|---|---|
| Maximum tensile force | longitudinally | 280 N |
| | transversely | 230 N |
| Maximum tensile stretching | longitudinally | 37% |
| | transversely | 38% |
| Tear propagation force | longitudinally | 120 N |

EXAMPLE 2

The same measures as in Example 1 were carried out, with the difference that polyethylene powder was applied to the tufted carpet in a layer, and sintering took place in a continuously operating furnace so that a coating is applied of a weight per unit area of 500 g polyethylene per square meter. After the preheating to 120° C., this carpet was shaped in a deforming press.

EXAMPLE 3

The same measures as in Example 1 were carried out, with the difference that both spinning cycles, under the conditions of spinning cycle A, were operated with polyester. The speed of the collecting belt was adjusted in such a way that a bonded fabric of 120 g/m$^2$ was formed and was sprinkled evenly with 15 g/m$^2$ of a polyethylene powder. This bonded fabric was then treated as indicated in Example 1.

What is claimed is:

1. A spunbonded fabric consisting of polyester matrix filaments that is suitable for use as a tufting base for carpets and that is strengthened by means of a binding component in the form of thermoplastically softenable filaments, characterized in that the binding component consists of polypropylene with a melting range of 150° to 160° C., that the melting range of the polyester matrix filaments is at least 90° C. above that of the binding component, and that the base, in the tufted condition, before the coating of the back, has a maximum tensile stretching value of more than 50%.

2. A tufting base according to claim 1, characterized in that the binding component consists of bicomponent filaments which are arranged laterally, i.e. side by side, one side consisting of polyester and the other of polypropylene.

3. A tufting base according to claim 1, characterized in that the binding component consists of bicomponent filaments in a core-shell arrangement, the core consisting of polyester and the shell of polypropylene.

4. A tufting base according to claim 1, characterized in that the weight of the binding agent part amounts to 10 to 50% of the overall weight of the tufting base.

5. A process for the manufacturing of a spunbonded fabric that is suitable for use as a tufting base for carpets and that consists of polyester matrix filaments and binding filaments characterized in that by means of a spinning system having longitudinal spinning nozzles that are arranged in groups next to one another, binding filaments of polypropylene with a melting range of 150° to 160° C. as well as polyester matrix filaments with a melting range of at least 90° C. above that of the binding filaments, are spun in rows and simultaneously in the shape of straight lined bands, are withdrawn aerodynamically, and are jointly deposited to form a mixed bonded fabric, and the mixed bonded fabric is then strengthened through the application of heat by partially or fully melting the binding component.

6. A tufted carpet of flat or deformed shape and containing a base material made of the spunbonded fabric according to claim 1.

* * * * *